United States Patent [19]

Martin

[11] 4,368,941

[45] Jan. 18, 1983

[54] ELECTRICAL JACK FRAME

[75] Inventor: Ronald G. Martin, Apple Valley, MN

[73] Assignee: Magnetic Controls Company, Minneapolis, Minn.

[21] Appl. No.: 127,769

[22] Filed: Mar. 6, 1980

[51] Int. Cl.[3] ..... H01R 17/18

[52] U.S. Cl. ..... 339/183; 179/96

[58] Field of Search ..... 339/182 R, 183, 22 B; 179/96, 97

[56] References Cited

U.S. PATENT DOCUMENTS

| | | | |
|---|---|---|---|
| D. 143,308 | 12/1945 | Haigh et al. | 179/96 X |
| 1,718,280 | 6/1929 | Edwards | 179/96 |
| 2,520,158 | 8/1950 | Lomholt | 179/96 |
| 3,784,962 | 1/1974 | Byrd | 339/182 R X |
| 3,822,415 | 7/1974 | Deitch | 339/182 X |

*Primary Examiner*—Joseph H. McGlynn

*Attorney, Agent, or Firm*—Dorsey & Whitney

[57] ABSTRACT

A jack frame for an electrical jack of the type having a plurality of jack springs and adapted for side-by-side mounting in an electrical jack panel. One embodiment includes a single piece of jack frame material bent into the desired configuration. A second embodiment includes a frame which is die cast in a single casting operation. The frames of both embodiments have improved rigidity and consistency.

5 Claims, 7 Drawing Figures

ELECTRICAL JACK FRAME

BACKGROUND OF THE INVENTION

The present invention relates generally to the field of electrical jacks, and more specifically, to an improved jack frame for an electrical jack of the type adapted for side-by-side mounting in an electrical jack panel.

In the prior art there are several forms of electrical jacks which are adapted for side-by-side mounting in an electrical jack panel. One example is the type shown in U.S. Pat. No. 3,822,415 which is commonly used for "telephones" or "communications". These types of jacks are constructed from a pair of generally "L" shaped frame members which are welded together along portions of opposing legs of the "L" shaped sections. In such jacks, a portion of the opposing legs which are welded together are separated at a free end to provide for the connection of a stack of jack springs and intermediate insulating blocks. Conventionally, a spacing block of insulating materials is also provided between the separated free ends of the opposing legs to insure proper separation therebetween and to increase the frame rigidity and consistency and resist compressive loads applied to the free ends. Most such jacks also include a pair of connecting straps welded together or a U-shaped frame support associated with the free ends to resist tensile loads on such free ends. The other opposing legs of the "L" shaped members extend outwardly from each other and support a plurality of jack sleeves for connecting one or more of the jack springs with a terminal.

While these prior art jacks function satisfactorily, they are quite expensive due in part to the fact that two "L" shaped sections have to be prepared and processed and joined together by welding and also due in part to the required insulated spacing block and connecting straps or frame supports to insure sufficient frame rigidity of the jack and to resist both compressive and tensile loading.

Accordingly, a need exists in the electrical jack field for an electrical jack and particularly an electrical jack frame which is less expensive, requires fewer structural parts and which also provides improved frame rigidity and consistency and improved resistance to compressive and tensile loading.

SUMMARY OF THE INVENTION

The present invention relates to an electrical jack of the type adapted for side-to-side mounting in an electrical jack panel in which the cost of construction is significantly less than prior art structures and in which the jack frame rigidity and consistency is improved. Thus, the resulting structure of the present invention requires fewer adjustment of parts at final assembly and more durable final end use by the customer. Further, because of the increased rigidity and consistency of the electrical jack of the present invention, the conventional insulating spacer block and connecting straps and frame supports normally used to provide rigidity and consistency to the prior art jacks and resistance to compressive and tensile loading is no longer required.

In one embodiment of the present invention, the jack frame is constructed of a single piece of elongated jack frame material which is bent into a configuration having a pair of jack sleeve mounting sections, a pair of support sections joined together in face-to-face relationship, a pair of spaced-apart jack mounting sections integrally joined with the support sections and a bridge section joining the ends of the jack mounting sections to provide structural rigidity and maintain desired separation thereof.

In a second embodiment of the present invention, the entire jack frame, including the jack sleeves, is cast in a single casting operation. The resulting structure includes a jack sleeve mounting section and a jack mounting section extending from the jack sleeve mounting section at right angles. The jack mounting section includes a pair of openings at its outer end to mount a plurality of jack springs and a pair of structural ribs to increase rigidity and consistency of the resulting electrical jack.

Accordingly, it is an object of the present invention to provide an electrical jack of the type adapted for side-by-side mounting in an electrical jack panel which is significantly less expensive to manufacture than prior jacks.

Another object of the present invention is to provide an electrical jack and in particular an improved jack frame for providing increased rigidity and consistency to the jack and improved resistance to both compressive and tensile loading.

Another object of the present invention is to provide an improved electrical jack constructed from a single piece of jack frame material bent into the desired configuration.

A further object of the present invention is to provide an electrical jack which is cast in a single casting operation.

These and other objects of the present invention will become apparent with reference to the drawings, the description of the preferred embodiment and the appended claims.

DESCRIPTION OF THE PREFERRED EMBODIMENT

Figure 1:
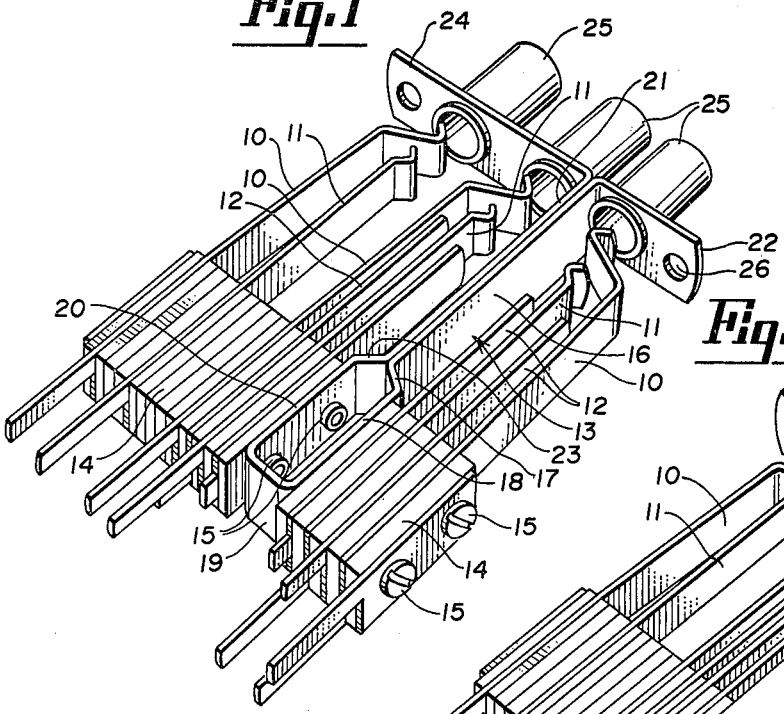
FIG. 1 is a pictorial view of a first embodiment of the electrical jack of the present invention.
Figure 4:
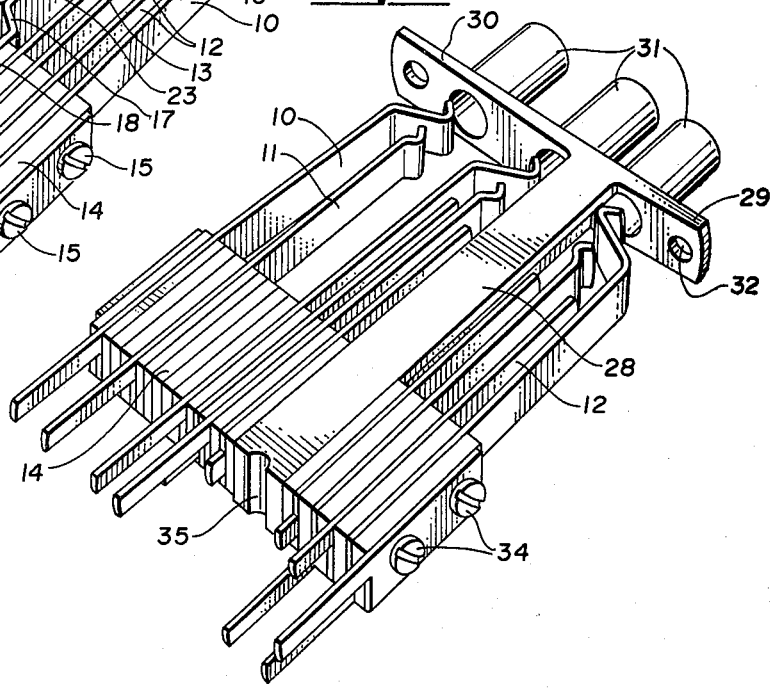
FIG. 4 is a pictorial view of a second embodiment of the electrical jack of the present invention.
Figure 2:
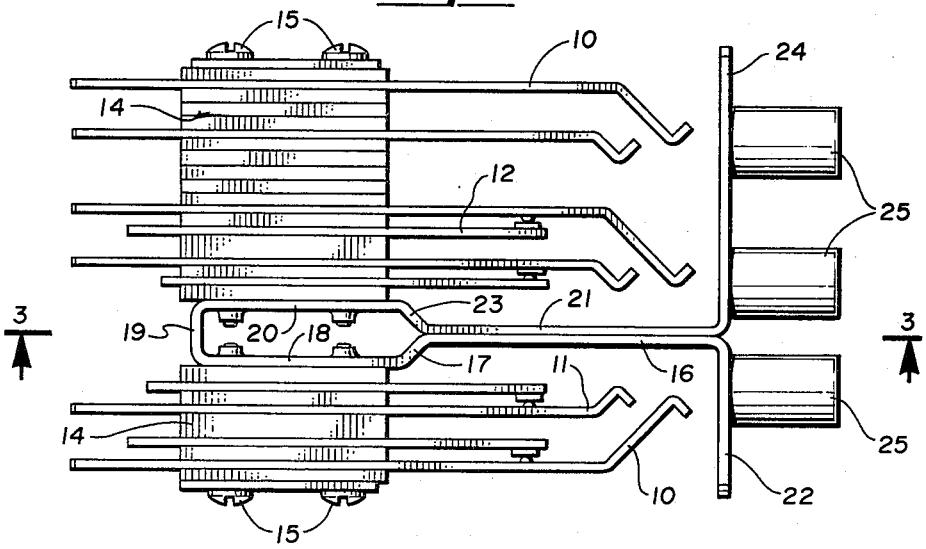
FIG. 2 is a plan top view of the first embodiment of the electrical jack of the present invention.
Figure 3:
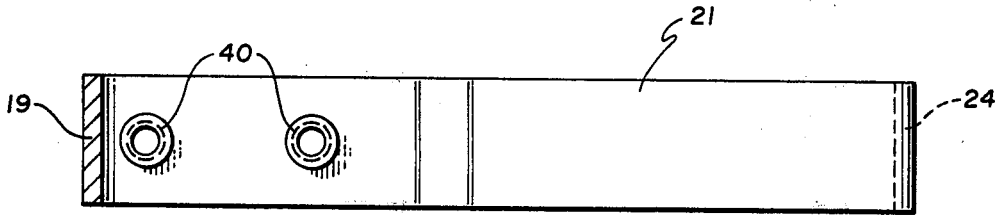
FIG. 3 is a sectional view of the first embodiment of the present invention as viewed along the section line 3—3 of FIG. 2.

Reference is first made to FIGS. 1, 2 and 3 showing various views of a first embodiment of the electrical jack of the present invention. As illustrated, the jack includes a jack frame assembly 13 to which are mounted a plurality of jack sleeves 25 and a plurality of jack springs 10, 11 and 12 and insulating blocks 14. The frame assembly and in particular the jack frame comprises a single elongated piece of jack frame material bent into a configuration having a plurality of frame sections. The frame includes a pair of elongated, generally flat opposing support sections 16 and 21 which are rigidly secured to each other along their opposing faces such that one flat surface of the support sections is secured to a flat surface of the other. In the preferred embodiment, the connection between the sections 16 and 21 is by spot welding, although other means of connection could be utilized such as rivets or the like. Integrally joined with one end of the frame sections 16 and 21 are corresponding sleeve support sections 22 and 24, respectively. The sleeve support sections 22 and 24 extend outwardly at right angles relative to their respective sections 16 and 20 and lie in a common plane. A plurality of jack sleeve members 25 are mounted to the sections 22 and 24 and extend outwardly at right angles therefrom in a direction opposite from the jack support sections 16 and 20. The jack sleeves 25 are generally cylindrical members having a cylindrical opening extending therethrough to provide electrical connection between a jack plug (not shown) and one or more of the jack springs 10, 11 and 12. The outer ends of the sleeve support sections 22 and 24 include a mounting hole 26 for connecting the jack frame to an electrical jack panel by appropriate connecting means such as a screw or bolt.

Integrally joined with the other ends of the sections 16 and 21 are a pair of jack spring mounting sections 18 and 20. The sections 18 and 20 are parallel to and spaced from each other and are joined with the support sections 16 and 21 by the angled connecting portions 17 and 23, respectively. As illustrated best in FIG. 3, each of the sections 18 and 20 includes a pair of openings 40 through which the screws 15 (FIGS. 1 and 2) extend to mount a plurality of jack spring elements 10, 11 and 12 and non-conductive mounting blocks 14. The jack spring elements 10, 11 and 12 are secured to their respective sections 18 and 20 in spaced relationship so that they are properly aligned and positioned with respect to the sleeves 25. A plurality of non-conductive spacing blocks 14 are disposed between the jack springs 10, 11 and 12 and between the jack springs and the sections 18 and 20 to electrically insulate the various jack springs from each other and to properly align and position them with respect to their respective jack sleeve 25.

The jack frame assembly 13 also includes an integral bridge section 19 having its ends integrally joined with opposing ends of the spaced jack mounting sections 18 and 20. Thus, as illustrated, the entire jack frame 13 comprising the individual sections 16-24 is constructed from a single piece of jack frame material. The resulting structure provides a significant product manufacturing cost reduction over the prior art structure which required two separate parts to be manufactured, processed and joined together. The bridge section 19 also provides frame rigidity and consistency such that less adjustment of parts at final assembly is required. This results in a more durable product. In this respect, it should be noted that the bridge 19 ties together what in the prior art had been the two halves of the spring jack assemblies. Without the bridge 19, introduction of a plug member into one of the jack sleeves 25 would cause a force to be exerted on a respective jack spring element 10, 11 or 12, thus creating a corresponding torque on one of the connecting sections 17 or 23 and at the base of the support sections 16 and 21. With extensive use, the connecting sections 17 and 23 become weakened, thus increasing the possibility of breaking. The bridge member 19 reduces the torque applied to the sections 17 and 23 by tying the entire structure together, thus improving the durability of the frame. In the preferred embodiment, the frame of FIGS. 1-3 is constructed from low carbon steel.

Figure 5:
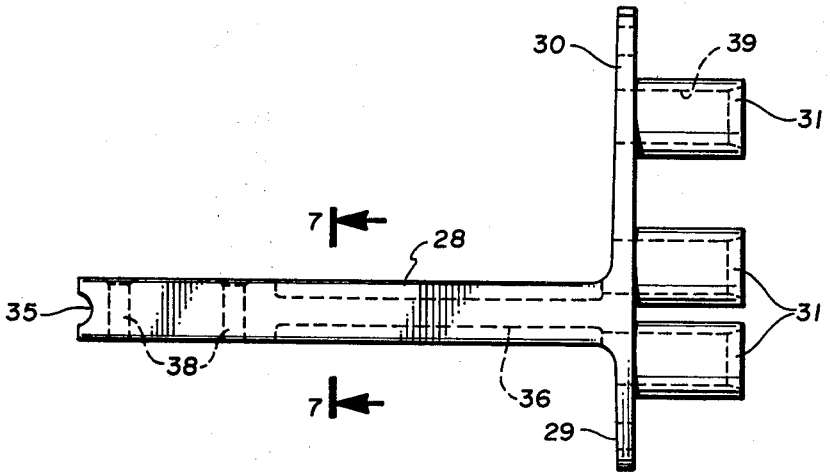
FIG. 5 is a plan top view of the jack frame of the second embodiment.
Figure 6:
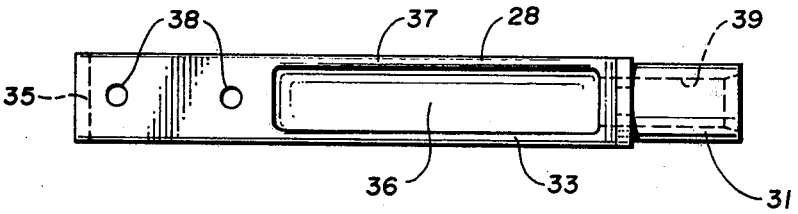
FIG. 6 is a plan side view of the jack frame of the second embodiment.
Figure 7:
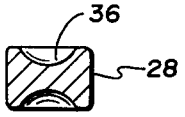
FIG. 7 is a sectional view of the electrical jack frame of the second embodiment as viewed along the section line 7—7 of FIG. 5.

Reference is next made to FIGS. 4, 5, 6 and 7 showing various views of a second embodiment of the present invention. As shown, this second embodiment is similar in general function and use to the first embodiment illustrated in FIGS. 1-3. In the second embodiment, however, the jack frame assembly is cast in a single casting operation from SAE 905 zinc. As shown, the frame assembly of the second embodiment includes an elongated jack mounting section 28 having a jack mounting portion with a pair of openings 38 (FIGS. 5 and 6). The jack mounting portion is a solid cast portion having a pair of parallel jack mounting surfaces. A recessed portion 35 is disposed at the end of the mounting portion to assist in retaining and properly positioning the frame during assembly. A plurality of jack spring members 10, 11 and 12 and a plurality of non-conductive spacing blocks 14 are mounted to the jack mounting portion by a pair of screw members 34. In this second embodiment, the screw members 34 extend through both stacks of jack springs and spacing blocks and through the mounting portion of the member 28. Thus, the second embodiment requires only two holes in the mounting portion as compared to the four holes required in the first embodiment of FIG. 1.

The jack mounting leg 28 also includes upper and lower reinforcement ribs 33 and 37 which are defined, in part, by the recessed portion 36. The ribs 33 and 37 extend from the forward end of the member 28 to the mounting section at which point the recessed portion 36 terminates. The ribs 33 and 37 provide increased rigidity to the jack frame and significantly reduces any relative rotational movement of the elongated mounting member 28 upon introduction of a plug.

Integrally joined with the forward end of the section 28 is a sleeve mounting portion comprising the sections 29 and 30. The sections 29 and 30 extend outwardly from the section 28 at right angles with respect thereto and in opposite directions from each other. The sections 29 and 30 are integrally cast with each other to form a common flat forward surface. Each section 29 and 30 includes a hole 32 at its outer end to enable the jack frame and associated hardware to be mounted in conventional manner to a jack panel (not shown). A plurality of jack sleeve members 31 are integrally formed with the forward surface of the sections 29 and 30 and extend outwardly therefrom at right angles. Each of the sleeves 31 is a generally cylindrical member and each includes a cylindrical opening 39 (FIG. 5) extending therethrough. As illustrated, the cylindrical opening 39 extends through the sleeves 31 and also through their respective sleeve mounting sections 29 and 30.

As shown best in FIG. 6, the rib sections 33 and 37 extend outwardly from each side of a central portion of the section 28. In the preferred embodiment, the ribs 33 and 37 extend outwardly to the extent that a portion extends beyond the projected extension of the cylindrical opening 39 in the two sleeves 31 nearest the section 28. Thus, the recessed portion 36 enables a plug to be introduced into the opening 39 of the sleeves 31 without interfering with the section 28 or the ribs 33 and 37.

Although the description of the preferred embodiment has been quite specific, it is contemplated that various changes could be made without deviating from the spirit of the present invention. Accordingly, it is intended that the scope of the present invention be dictated by the appended claims rather than by the description of the preferred embodiment.

I claim:

1. A jack frame for an electrical jack of the type having a plurality of jack springs and adapted for side-by-side mounting in an electrical jack panel, said jack frame being cast as an integral unit and comprising:

a jack sleeve mounting section having a rearward surface, a generally flat forward surface and a pair of side edges;

at least two jack sleeve members integrally cast with said forward surface and extending outwardly at right angles therefrom, said jack sleeve members being generally cylindrical members and having a generally cylindrical opening extending therethrough;

an elongated jack spring mounting section integrally cast with said rearward surface of said jack sleeve mounting section between said pair of side edges and between two adjacent jack sleeve members, said elongated jack spring mounting section including first and second opposing edges and extending outwardly at right angles from said rearward surface in a direction opposite said jack sleeve members such that said first and second opposing edges are substantially flush with respect to said pair of side edges;

means near the outer end of said jack spring mounting section for mounting a plurality of jack springs; and said elongated jack spring mounting section further including a pair of integrally cast reinforcement ribs extending laterally otwardly in opposite directions from each of said first and second opposing edges such that one of the reinforcement ribs of each of said pairs of reinforcement ribs includes a portion extending past a projected extension of the cylindrical opening of one of said two adjacent jack sleeve members and the other reinforcement rib of each of said pairs of reinforcement ribs includes a portion extending past a projected extension of the cylindrical opening of the other of said two adjacent jack sleeve members .

2. The jack frame of claim 1 including a plurality of jack springs and non-conductive spacing blocks connected with said jack spring mounting section.

3. The jack frame of claim 1 wherein said jack spring mounting section includes a jack spring mounting portion near its outer end, said mounting portion being a solid cast portion and having a pair of parallel jack spring mounting surfaces.

4. The jack frame of claim 3 wherein said ribs extend from the rearward surface of said jack sleeve mounting section to said jack spring mounting portion.

5. The jack frame of claim 4 having a recessed portion at the outer end of said jack spring mounting portion to assist in assembly of the electrical jack.

* * * * *